US005107669A

United States Patent [19]

Stahlecker

[11] Patent Number: 5,107,669

[45] Date of Patent: Apr. 28, 1992

[54] DRAFTING UNIT FOR A SPINNING MACHINE

[75] Inventor: Fritz Stahlecker, Bad Überkingen, Fed. Rep. of Germany

[73] Assignee: Hans Stahlecker, Fed. Rep. of Germany; a part interest

[21] Appl. No.: 530,316

[22] Filed: May 30, 1990

[30] Foreign Application Priority Data

Jun. 2, 1989 [DE] Fed. Rep. of Germany ..... 3917990

[51] Int. Cl.[5] ..... D01H 11/00; D01H 5/60

[52] U.S. Cl. ..... 57/300; 19/265

[58] Field of Search ..... 19/245, 262, 263, 264, 19/265; 57/300, 301, 303, 304, 306, 315

[56] References Cited

U.S. PATENT DOCUMENTS

| | | | |
|---|---|---|---|
| 1,519,139 | 12/1924 | Keyes | 19/265 X |
| 2,328,324 | 8/1943 | Burman, Jr. | 19/265 X |
| 2,951,268 | 9/1960 | West | 19/265 X |
| 3,086,255 | 4/1963 | Cordis | 19/265 X |
| 3,377,665 | 4/1968 | Kincaid | 19/263 |
| 3,523,335 | 8/1970 | Ingham, Jr. | 19/263 |
| 4,317,261 | 3/1982 | Adamson | 19/265 |
| 4,370,781 | 2/1983 | Murao | 19/245 |

FOREIGN PATENT DOCUMENTS

| | | | |
|---|---|---|---|
| 3209210 | 11/1985 | Fed. Rep. of Germany . | |
| 3522504 | 1/1987 | Fed. Rep. of Germany . | |
| 59-130324 | 7/1984 | Japan . | |
| 7307085 | 5/1973 | Netherlands | 19/265 |

*Primary Examiner*—Daniel P. Stodola
*Assistant Examiner*—John F. Rollins
*Attorney, Agent, or Firm*—Evenson, Wands, Edwards, Lenahan & McKeown

[57] ABSTRACT

A drafting unit is disclosed for a spinning machine having a load carrier which can be swivelled around a carrying rod extending in parallel with respect to bottom rollers. A carrying part is provided for a cleaning device which comprises two cleaning rags constructed as continuous loops, and which is constructed as a frame with two legs extending in parallel with respect to the load carrier and one crosshead. The frame is pivotally disposed at the load carrier in the vicinity of the carrying rod so as to accommodate lifting of the cleaning rags out of their cleaning position without requiring opening of the drafting unit.

27 Claims, 2 Drawing Sheets

DRAFTING UNIT FOR A SPINNING MACHINE

BACKGROUND AND SUMMARY OF THE INVENTION

The invention relates to a drafting unit for a spinning machine having a load carrier which can be pivoted around a carrying rod extending in parallel to the bottom rollers and which carries pressure rollers which are assigned to the bottom rollers and are constructed as pressure roller pairs. A pivotally disposed carrying part is provided for a cleaning device comprising two cleaning rags constructed as continuous loops which, with one end respectively, are assigned to the circumferential surfaces of the pressure rollers facing away from the bottom rollers.

In a drafting unit of the initially mentioned type (JP-A 59-130 324), the carrying part holding the cleaning device as well as the load carrier are disposed at the carrying rod. In order to open the drafting unit, the carrying part must first be swivelled away before the drafting unit becomes accessible.

It is also known from German Published Examined Patent Application (DE-A) 35 22 504 to install a cleaning device having cleaning rags into the load carrier in such a manner that the cleaning device moves along with the opening and closing of the load carrier.

It is also known from German Patent (DE-C) 32 09 210 to construct a load carrier with two legs which are disposed so that they can be pivoted and locked separately. This load carrier is covered by means of a covering which covers the two legs and also the area located between them.

It is an object of the invention to construct a drafting unit of the initially mentioned type in such a manner that it is user-friendly.

This object is achieved in that the carrying part of the cleaning device is constructed as a frame reaching around the load carrier with two legs extending in parallel to the load carrier and one crosspiece, this frame being pivotally disposed at the load carrier in the vicinity of the carrying rod.

By means of this construction, it is achieved that the carrying part with the cleaning device, together with the load carrier, can be swivelled away from the bottom rollers without the requirement of having separate handles for the swivelling-away of the cleaning device and of the load carrier.

In an advantageous development of the invention, it is provided that the carrying part of the cleaning device is held in the operative position by means of a spring force. As a result, the load may be determined by means of which the cleaning rags rest against the pressure rollers. It is also advantageous that, in a further development of the invention, the carrying part of the cleaning device supports itself at the load carrier in the operating position. As a result, it becomes possible to press the cleaning rags against the pressure rollers by means of precisely defined forces, in which case, at the same time, the contact surfaces of the cleaning rags are also defined. A support of the carrying part is achieved in a simple manner by the fact that the crosshead supports itself on the top side of the load carrier in the operating position.

Other objects, advantages and novel features of the present invention will become apparent from the following detailed description of the invention when considered in conjunction with the accompanying drawings.

DETAILED DESCRIPTION OF THE DRAWINGS

Figure 2:
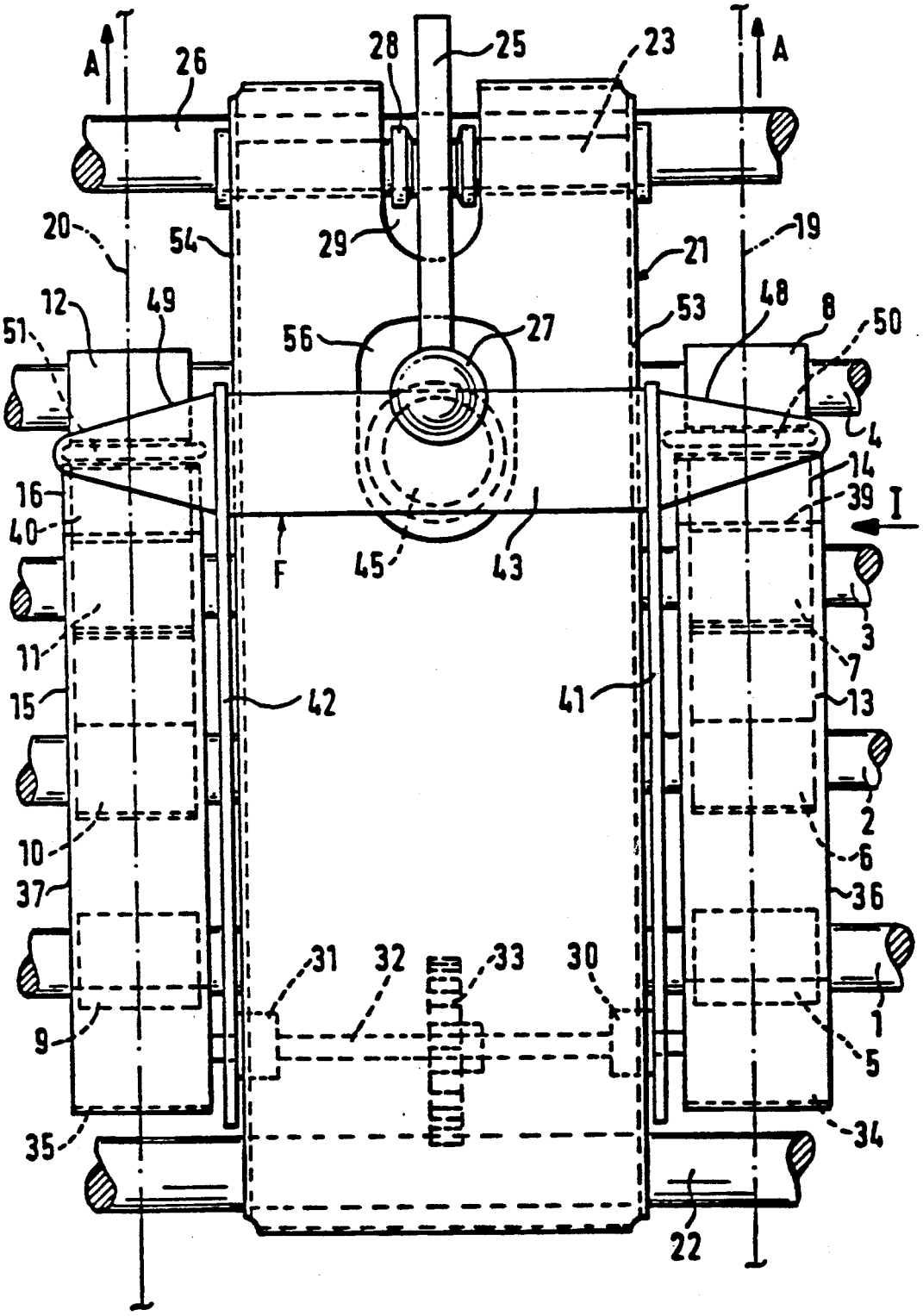
FIG. 2 is a schematic top view of the drafting unit of FIG. 1 taken in the direction of arrow II of FIG. 1.

The shown drafting unit comprises four bottom rollers 1, 2, 3, 4 arranged in parallel to one another. In the shown embodiment, these are constructed as drivable bottom cylinders extending through in the longitudinal direction of the machine. As a modification of the shown drafting unit, it is also contemplated to provide more bottom rollers or less bottom rollers, if required, and/or to construct them as individually drivable roller stubs. Pressure rollers 5, 6, 7, 8 for a first sliver 19 and pressure rollers 9, 10, 11, 12 (FIG. 2) for a second sliver 20 to be drawn are assigned to the bottom rollers 1 to 4. The two slivers 19, 20 move through the drafting unit in the direction of the arrow (A).

The pressure rollers 5 to 8 and the pressure rollers 9 to 12 assigned to an adjacent spinning unit or point are combined into so-called pressure roller pairs which are carried in a load carrier 21 in a manner not shown in detail, each with a common axis. Top aprons 13, 14, 15, 16 are assigned to the pressure rollers 6, 7, 10, 11. Corresponding bottom aprons 17, 18 are assigned to the bottom rollers 2, 3 of the two spinning points.

The load carrier 21 can be pivoted around a carrying rod 22 which is parallel to the bottom rollers 1 to 4. By means of a locking device, it can be locked in the operating position in which the pressure rollers 5 to 8 and 9 to 12, under the load of a spring, are pressed against the bottom rollers 1 to 4. The locking device comprises a locking lever 25 which can be pivoted around a stationary shaft arranged on the side facing away from the carrying rod 22 and which, at its free end, is provided with a handle 27. The locking lever 25 can be applied to a locking bolt 23 which is mounted at the load carrier 21 by means of a locking recess 24. The locking bolt 23 is provided with lateral guide surfaces 28 which have an inlet slope which places itself against the locking lever 25 and which therefore centers the load carrier 21 with respect to the locking lever 25. The load carrier 21 is essentially constructed as a bent sheet metal profile which is provided with a recess 29 in the area of the locking bolt 23.

At the two lateral legs 53, 54 of the load carrier 21 extending in radial planes with respect to the carrying rod 22, bearings 30, 31 are mounted in the vicinity of the carrying rod 22 by means of which a frame f which is formed of two legs 41, 42 and one crosshead 43, is pivotally disposed at the load carrier 21. The legs 41, 42 of this frame f are respectively disposed between the respective legs 53, 54 of the load carrier 21 and the respective pressure rollers 5 to 8 and 9 to 12 which follow. These two legs 41, 42 which, together with the crosshead 43, form a U-shaped frame f, are used as a carrying part for cleaning devices. These cleaning devices contain two cleaning rags 36, 37 which, by means of deflecting rollers 34, 39; 35, 40, are guided in such a manner that one section 38 (FIG. 1) respectively is disposed opposite the circumferential surfaces of the pressure rollers 5 to 8; 9 to 12 which face away from the bottom rollers 1 to 4. The deflecting rollers 34, 35 are driven by means of a common shaft 32 which is rotatably disposed in the swivel bearings 30, 31; coaxially with respect to the swivel axis of the frame 41, 42, 43. The drive of the shaft 32 takes place by way of a toothed wheel 33 which, in turn, is driven by a shaft which is not shown and extends through in the longitudinal direction of the machine, for example, also by means of one of the bottom rollers 1 to 4. The deflecting rollers 39, 40 are overmounted on the exterior side of the legs 41, 42.

Figure 1:
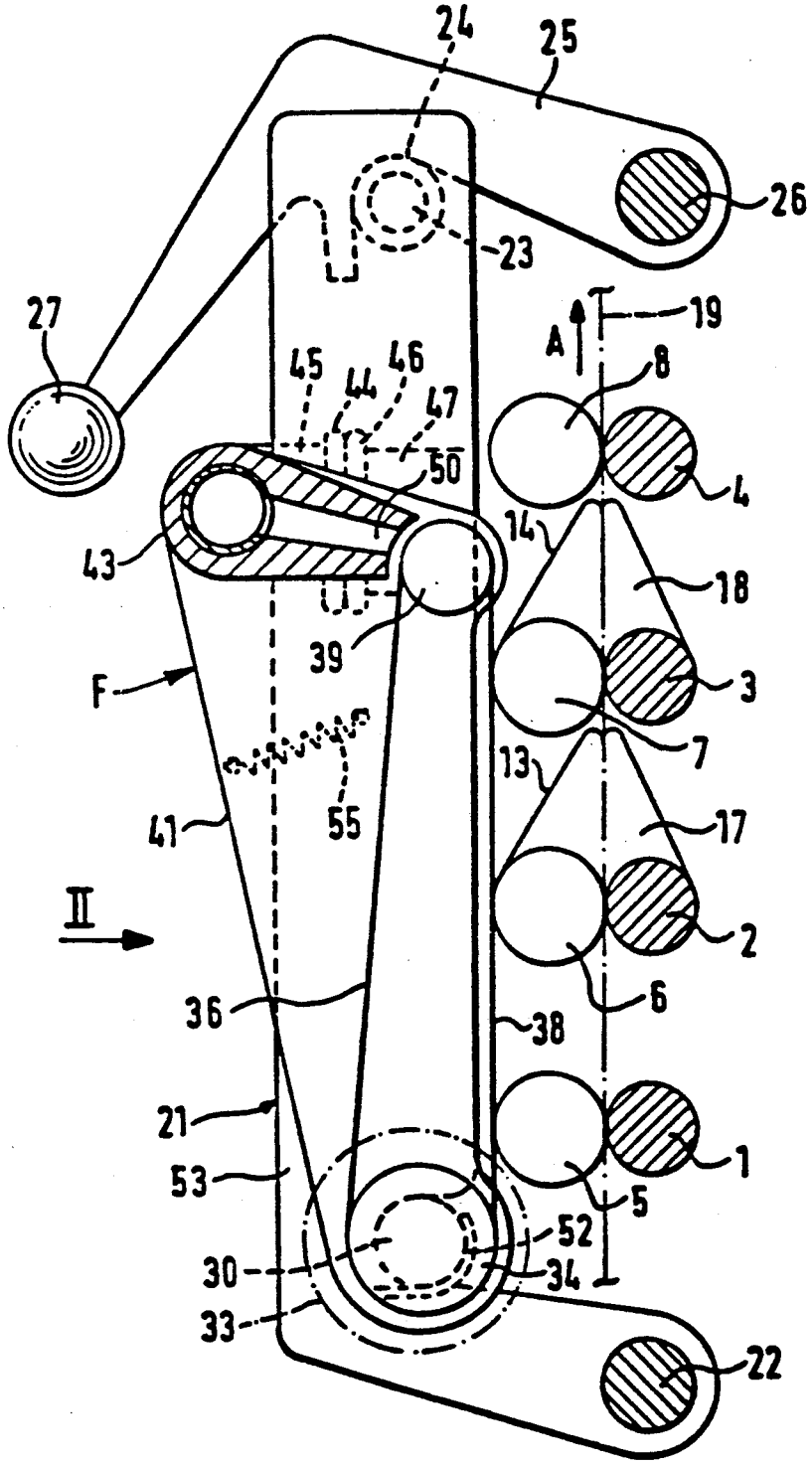
FIG. 1 is a schematic partially sectioned lateral view taken in the direction of the arrow I of FIG. 2 of a drafting unit, constructed according to a preferred embodiment of the invention.

As shown in FIG. 1, the bearings 30, 31 are arranged in recesses of the bent legs 53, 54 of the load carrier 21 and, by means of bow-shaped holders 52, are secured in such a manner that the bent legs 53, 54 can be swivelled still within this bearing.

In the operating position (FIG. 1), the crosshead 43 rests against the top side of the load carrier 21. In this case, one section 38 of the cleaning rags 36, 37 respectively rests against the pressure rollers 5 to 8, 9 to 12. The contact pressure force is determined by a tension spring 55 which, at least on one side, is arranged between the leg 41 of the frame f and the leg 53 of the load carrier 21. While overcoming the force of the tension spring 55, the frame f 41, 42, 43 with the cleaning rags 36, 37 can therefore be lifted off the pressure rollers 5 to 8; 9 to 12, without any opening of the drafting unit; i.e., without any moving of the load carrier 21. If, on the other hand, the locking lever 25 is swivelled away, the load carrier 21, by means of a handle, can be swivelled away together with the cleaning devices.

The cleaning device also comprises a suction device which is partially integrated into the crosshead 43. The crosshead 43 is constructed as a pipe which is extended laterally beyond the legs 41, 42 by means of suction nozzle projections 48, 49 which, in each case, by means of a suction slot 50, 51 are disposed opposite the cleaning rags 36, 37 in the area of the deflecting rollers 39, 40. In the central area, the crosshead 43 constructed as a pipe is provided with a suction piece 45 which rests in the operating position by means of an elastic connecting ring 44 against an elastic connecting ring 46 of a stationary suction piece 47. The load carrier 21 is provided with a recess 56 in this area.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A drafting unit for a spinning machine comprising:

a plurality of bottom rollers disposed in a parallel to and adjacent one another along a sliver travel path, a load carrier pivotably mounted at a carrying rod extending parallel to the bottom rollers, pressure rollers carried by the load carrier which are assigned to respective ones of the bottom rollers, said pressure rollers being disposed so that the load carrier carries axially spaced pairs of pressure rollers which cooperate with the bottom rollers to form a pair of adjacent sliver travel paths, a cleaning device carrying part connected to the load carrier, and a pair of respective continuous loop cleaning rags carried by the carrying part and engageable with the respective pairs of pressure rollers carried by the load carrier, wherein the cleaning device carrying part includes a frame with a cross head extending in parallel to the pressure rollers and tow legs connected to the cross head, said legs extending along respective lateral sides of the load carrier in parallel to the sliver travel paths, and wherein said frame is pivotally connected to the load carrier to accommodate access to the cleaning device independently of the position of the load carrier while also accommodating automatic movement of the cleaning device out of its operative cleaning position upon movement of the load carrier to an open inoperative position.

2. A drafting unit according to claim 1, wherein spring means are provided for holding the carrying part of the cleaning device in its operating position by means of spring force.

3. A drafting unit according to claim 2, wherein the carrying part comprises a shaft for the driving of the cleaning rags, said shaft being arranged coaxially with respect to a swivel axis of the carrying part.

4. A drafting unit according to claim 2, wherein the legs of the carrying part in the area of the crosshead are provided with over-mounted deflecting rollers for the two cleaning rags.

5. A drafting unit according to claim 2, wherein the cleaning device carrying part rests against the load carrier when in its operating position.

6. A drafting unit according to claim 5, wherein the crosshead is supported on the top side of the load carrier when the cleaning device carrying part is in its operating position.

7. A drafting unit according to claim 6, wherein the carrying part comprises a shaft for the driving of the cleaning rags, said shaft being arranged coaxially with respect to a swivel axis of the carrying part.

8. A drafting unit according to claim 6, wherein the legs of the carrying part in the area of the crosshead are provided with over-mounted deflecting rollers for the two cleaning rags.

9. A drafting unit according to claim 6, wherein the crosshead is pipe-shaped and is a component of a suction intake device assigned to the cleaning rags.

10. A drafting unit according to claim 1, wherein the cleaning device carrying part rests against the load carrier when in its operating position.

11. A drafting unit according to claim 10, wherein the crosshead is supported on the top side of the load carrier when the cleaning device carrying part is in its operating position.

12. A drafting unit according to claim 11, wherein the carrying part comprises a shaft for the driving of the cleaning rags, said shaft being arranged coaxially with respect to a swivel axis of the carrying part.

13. A drafting unit according to claim 11, legs of the carrying part in the area of the crosshead are provided with over-mounted deflecting rollers for the two cleaning rags.

14. A drafting unit according to claim 11, wherein the crosshead is pipe-shaped and is a component of a suction intake device assigned to the cleaning rags.

15. A drafting unit according to claim 1, wherein the carrying part comprises a shaft for the driving of the cleaning rags, said shaft being arranged coaxially with respect to a swivel axis of the carrying part.

16. A drafting unit according to claim 15, wherein the legs of the carrying part in the area of the crosshead are provided with over-mounted deflecting rollers for the two cleaning rags.

17. A drafting unit according to claim 15, wherein the crosshead is pipe-shaped and is a component of a suction intake device assigned to the cleaning rags.

18. A drafting unit according to claim 1, wherein the legs of the carrying part in the area of the crosshead are provided with over-mounted deflecting rollers for the two cleaning rags.

19. A drafting unit according to claim 18, wherein the crosshead is pipe-shaped and is a component of a suction intake device assigned to the cleaning rags.

20. A drafting unit according to claim 1, wherein the crosshead is pipe-shaped and is a component of a suction intake device assigned to the cleaning rags.

21. A drafting unit according to claim 20, wherein spring means are provided for holding the carrying part of the cleaning device in its operating position by means of spring force.

22. A drafting unit according to claim 20, wherein the crosshead is equipped with suction nozzles which are each assigned to a cleaning rag.

23. A drafting unit according to claim 22, wherein the pipe-shaped crosshead is equipped with a suction connection which connects to a stationary suction pipe when the carrying part is in its operating position.

24. A drafting unit according to claim 1, further comprising a releasable locking device for locking the load carrier in its operating position.

25. A drafting unit according to claim 24, wherein said locking device is engageable with the load carrier at an end of the load carrier opposite the carrying rod.

26. A drafting unit according to claim 25, wherein said locking device includes a locking bolt carried by the load carrier and a movable locking lever engageable with the locking bolt.

27. A drafting unit according to claim 26, wherein said load carrier is formed from a sheet metal profile which is provided with a recess in the area of the locking bolt.

* * * * *